US005518847A

United States Patent [19]

Chen

[11] Patent Number: 5,518,847

[45] Date of Patent: May 21, 1996

[54] ORGANIC PHOTOCONDUCTOR WITH POLYDIVINYL SPIROBI (M-DIOXANE) POLYMER OVERCOATING

[75] Inventor: Chih-Chiang Chen, Hsinchu, Taiwan

[73] Assignee: Industrial Technology Research Institute, Hsinchu Hsien, Taiwan

[21] Appl. No.: 514,524

[22] Filed: Aug. 14, 1995

[51] Int. Cl.[6] ..... G03G 5/047; G03G 5/147

[52] U.S. Cl. ..... 430/59; 430/58; 430/66; 430/67

[58] Field of Search ..... 430/58, 59, 66, 430/67

[56] References Cited

U.S. PATENT DOCUMENTS

| | | | |
|---|---|---|---|
| 4,489,148 | 12/1984 | Horgan | 430/59 |
| 4,923,775 | 5/1990 | Schank | 430/66 |
| 5,166,021 | 11/1992 | Odell et al. | 430/58 |
| 5,270,139 | 12/1993 | Yeng et al. | 430/58 |
| 5,350,822 | 9/1994 | Chen | 526/266 |

*Primary Examiner*—Roland Martin
*Attorney, Agent, or Firm*—W. Wayne Lianh

[57] ABSTRACT

An improved organic photoconductor is disclosed which comprises: (a) a conductive substrate; (b) a charge generation layer; (c) a charge transport layer; and (d) a reinforcing overcoating layer. The reinforcing overcoating layer contains a polymer resin prepared from a reaction mixture comprising: (i) about 87 to 94 wt % of a bifunctional 3,9-divinyl spirobi(m-dioxane) and styrene; (ii) about 5 to 8 wt % of maliec acid di-allyl ester; and (iii) about 1 to 5 wt % of a heat-induced polymerization initiator. The organic photoconductor exhibits light and heat stability and abrasion resistance comparable to those of inorganic photoconductors, but it eliminates many of the shortcomings, such as toxicity and enviromental pollution problems, that have been recognized as being associated with the inorganic photoconductors. Furthermore, the provision of this overcoating layer does not cause any loss of performance, as measured by the residual potential under various test conditions.

13 Claims, 1 Drawing Sheet

ORGANIC PHOTOCONDUCTOR WITH POLYDIVINYL SPIROBI (M-DIOXANE) POLYMER OVERCOATING

FIELD OF THE INVENTION

The present invention relates to organic photoconductors for use in xerographic devices such as copiers and laser printers, etc. More specifically, the present invention relates to organic photoconductors for use in xerographic devices such as copiers and laser printers, etc which exhibit excellent stability against light and heat and excellent abrasion resistance, and are environmentally compatible.

BACKGROUND OF THE INVENTION

Xerography has become one of the most important everyday events in today's office environment. A xerographic process, which allows high quality permanent images to be produced from xerographic devices such as copiers and laser printers, comprises a sequence of steps which include: (1) charging, i.e., causing a photoconductor to become charged; (2) forming electrostatic latent images on the photoconductor upon exposure to light (i.e., corona discharge); (3) using a toner to develop positive images on the photoconductor; (4) transferring the positive images from the photoconductor to a print medium, which can be a plain paper or a transparent film; (5) fusing, i.e., fixing the positive images on the print medium; (6) cleaning the remaining toners from the photoconductor; and (7) erasing electric charges from the photoconductor. From these many functions that a photoconductor is involved in a xerographic process, there is no doubt that the photoconductor is the nerve center of a xerographic device, just like what a heart is with respect to a human body.

Photoconductors can be classified according to their constituent materials as either an inorganic or an organic photoconductor (OPC). Traditionally, the photoconductors that have been used in copiers such as selenium (Se), cadium sulfide (CdS), non-crystalline silica (α-Si), etc., belong to the class of inorganic photoconductors. Inorganic photoconductors have the advantages of high sensitivity, high hardness, high abrasion-resistance, and can be used for making hundred of thousands prints with little or no degradation in print quality. However, inorganic photoconductors also present many disadvantages such as the high manufacturing cost and the relatively difficult quality control, etc.

On comparison, organic photoconductors, which can be more easily and relatively inexpensively manufactured, have gradually replaced inorganic photoconductors as the main stream material in the market for use with laser printers and certain copiers. Organic photoconductors also have the advantages of having low or no toxicity and thus do not cause pollution problems, and can produce sharp images. However, organic photoconductors have often been recognized as having the shortcomings of lacking the same light and heat stability as inorganic photoconductors, and are of relatively shorter service life. Due to these weaknesses, organic photoconductors are largely limited in their use to low to medium speed copiers.

As organic photoconductor is an insulator when it is not exposed to light. After exposure to a light source, the incident photons from the light source are absorbed, resulting in a charge separation which causes electron-hole pairs to be formed. Under the influence of an externally applied electric field, the electrons and holes so formed will move in opposite directions, thus enabling the organic photoconductor to become an electric conductor. One of the key elements of the photoconductors is that, when charges are generated upon exposure to light, the electric charges are maintained on their surface after the incident light is terminated. The ability to prevent the charges to be quickly neutralized is one of the important characteristics required of a good organic photoconductor (or of any photoconductor, organic or inorganic). An organic photoconductor also provides the required structure to conduct the electric charges.

While organic photoconductors can be classified, according to their development history, as belonging to either the single-layer type or the functionally-separated multi-layer type, the functionally-separated multi-layer types are of the predominant type. A functionally-separated photoconductor comprises a charge generation layer (CGL) and a charge transport layer (CTL). The two layers provide the separate but cooperating functions such that when the charge generating layer is exposed to light, electron-hole pairs will be generated therein. And the charge transport layer causes the generated charges to be transported to the surface of the photoconductor.

The charge generation layer typically contains a charge generation material (CGM), such as phthalocyanine pigments, azo pigments, etc., uniformly dispersed in a polymeric binder. The charge generating material is provided to absorb the incident light and produce resultant charges. In order to provide adequate light absorption, the thickness of the charge generating layer is typically designed to be between 0.1 and 0.3 μm. Similarly, the charge transport layer typically contains a charge transport material (CTM), such as triphenylamine, etc., dissolved in a polymeric binder. The functionality of the charge transport layer is provided by the small organic molecules (i.e., the charge transport materials contained therein), while the polymeric binder provides the required filmability, insulation and mechanical strengths, etc. On the one hand, the charge transport layer must have an adequate thickness so as to provide the required mechanical strength. On the other hand, its thickness must not be too large so as to impede the speed of charge transport. Typically, the thickness of the charge transport layer is provided which has a thickness of about 10 to 30 μm.

The transportability of an organic photoconductor, i.e., the speed at which charges can be transported in a charge transport layer, is determined primarily by two factors: (1) the compatibility between the charge transport material and the polymeric binder, the charge transport material must be soluble in the polymer binder; and (2) concentration of the charge transport material in the polymer binder. In order to increase the transportability of the charge transport layer, the concentration of the charge transport material must be relatively high, so as to reduce the intermolecular distance therebetween. However, a higher concentration of the charge transport material would inevitably reduce the mechanical strength of the charge transport layer and decrease the service life of the organic photoconductor made therefrom. Furthermore, in order to satisfy the first requirement stated above and maintain a manageable cost structure, the polymer binders are typically selected from a limited number of well-known commercially available thermoplastic resins such as polycarbonate, polystyrene, poly(methyl methacrylate) (PMMA). These thermoplastic resins have limited mechanical strength and relatively low hardness. Thus, there are practical limits, under the current constraints, within which the service life of the organic photoconductor can be extended.

In U.S. Pat. No. 4,489,148, the content thereof is incorporated by reference, it is disclosed an improved photoconductive device comprised of a substrate, an adhesive layer, a hole transport layer, an inorganic panchromatic layer, an organic photoconductive layer sensitive to infrared radiation, an inorganic photogenerating layer, and a polymeric overcoating layer. The organic photoconductive layer is selected from the group consisting of organic photoconductive compositions, charge transfer complex compositions, dye sensitizers, or mixtures thereof. The hole transport layer contains hole-transporting materials dissolved in transparent resinous material such as polycarbonates, polyesters, phenoxys, etc. These polymers do not provided observable improved mechanical strength.

In U.S. Pat. No. 4,923,775, the content thereof is incorporated by reference, it is disclosed an improved electrophotographic imaging member comprising a supporting substrate, at least on photoconductive layer and an overcoating layer comprising a polymerized silane. The polymerized silane comprises a reaction product of hydrolyzed alkoxy silane. The overcoating layer overlies a charge transport layer, which comprises a diamine dispersed in a polycarbonate resin.

In U.S. Pat. No. 5,166,021, the content thereof is incorporated by reference, it is disclosed improved layered photoresponsive or photoconductor imaging members containing a protective polycarbonatefluorosiloxane polymer overcoating. The imaging members contain a hole transport layer with a polycarbonate resin binder. One of the shortcomings of the organic photoconductor disclosed in the '021 patent was that it did not provide sufficient abrasion resistance or surface hardness.

In U.S. Pat. No. 5,270,139, the content thereof is incorporated by reference, it is disclosed an improved photoconductive device comprising a conductive substrate, a charge generation layer and a charge transport layer. The charge transport layer contains a charge transport material dissolved in a copolymer of styrene and methyl methacrylate.

Organic photoconductors offer many strong advantages such as lowered manufacturing cost, high mass-producibility (via a variety of available coating techniques), low pollution, and flexibility of molecular design to tailor for a specific application, over their inorganic counterparts. However, the usage of the organic photoconductors has been hampered primarily by their relatively inferior photosensitivity, inadequate mechanical strength, and relatively short service life. As the issue relating to environmental pollution has become an increasingly important concern, it is highly desirable to expend research and development effort so that we can further improve the properties of organic photoconductors such that they can satisfactorily replace inorganic photoconductors and eliminate or substantially minimize a potential pollution stream from entering our prescious and increasingly volunerable environment.

SUMMARY OF THE INVENTION

The primary object of the present invention is to develop an organic photoconductor which exhibits improved light and heat stability, and improved abrasion resistance. More specifically, the primary object of the present invention is to develop an improved organic photoconductor which exhibits light and heat stability and abrasion resistance comparablee to those of inorganic photoconductors, while eliminating many of the shortcomings, such as toxicity and enviromental pollution problems, that have been recognized as being associated with the inorganic photoconductors.

The improved organic photoconductor disclosed in the present invention belongs to the type of functionally-separated multiple-layered (i.e., laminated) photoconductors. It comprises a conductive substrate, a charge generating layer, a charge transport layer, and an overcoating layer. The overcoating layer of the organic photoconductor disclosed in the present invention is a reinforcing polymer resin layer containing a poly(3,9-divinyl spirobi(m-dioxane))polymer, which imparts substantially improved light and heat resistance, as well as improved hardness and abrasion-resistance, to the organic photoconductors disclosed in the present invention. The method in preparing the poly(3,9-divinyl spirobi(m-dioxane))polymer has been disclosed in another invention made by the same inventor of the present invention, U.S. patent application Ser. No. 08/079,359, now U.S. Pat. No. 5,350,822, entitled: "High Refractive Index Plastic Lens Composition", the content thereof is incorporated herein by reference.

The overcoating layer of the present invention is prepared by first preparing a mixture containing: (1) a bifunctional 3,9-divinyl spirobi(m-dioxane); (2) styrene, the sum of the 3,9-divinyl spirobi(m-dioxane) and styrene being about 87 to 94 wt % of the mixture; (3) maleic acid di-allyl ester, about 5 to 8 wt %; (4) a heat curing initiator, about 1 to 5 wt %. Then polymerizing the mixture at 120° to 150° C. for one hour. The bifunctional 3,9-divinyl spirobi(m-dioxane) and styrene can be provided at various proportions relative to each other. Various types of heat curing initiators can be used in the present invention, a preferred example of such heat-induced polymerization initiators is p-dicumyl peroxide.

In preparing the organic photoconductors of the present invention, a charge generating layer is first prepared by dispersing a charge generating material in a polymer binder and an appropriate solvent to form a charge generating coating composition. The charge generating coating composition is then coated on the conductive substrate using any coating procedure, such as dip-coating, blade coating, flow coating, spraying, draw bar coating, and Meyer Bar coating, to form a charge generating layer of about 0.1 to 1 μm. After coating, the charge generating layer is placed inside an oven to be dried. The polymer binder should be a polymer insulator, and the preferred polymer binders include polyesters, polycarbonates, polyvinyl butyrate, phenolic resins, polyamides, and phenoxy resins. The ratio between the charge generating material and the polymer binder should preferably between 3:1 and 1:3. The organic solvents to be used in conjunction with the polymer binder should those which can dissolve the polymer binder but will not dissolve the charge tranport layer. Preferred organic solvents include tetrahydrofuran, 1,4-dioxane, cyclehexanone, methyl ethyl keton, N,N-diethylformamide, etc. The solid content in the charge generating composition should preferably be between 0.5% and 5.0%, by weight.

After the charge generation layer is formed, a charge transport layer is coated onto the charge generation layer. The charge transport layer is prepared by dissolving a charge transport material and a polymer binder in an appropriate solvent to prepare a charge transport coating composition. Preferred charge transport materials include hydrazones such as p-diethylaminobenzaldehyde-N-N-diphenyl hydrazone; 2-pyrazolines such as 1-phenyl-3-(p-diethylaminophenyl-propenol)-5-(p-diethylaminophenyl)2 -pyrazoline; and triaryl methanes such as bis(4-diethylamino-2-methylphenyl)-phenylmethane. Preferred polymer binders for use in preparing the charge transport layer include acrylic resins, polyallylates, polyesters, polycarbonates, polystyrenes, copolymers of acrylonitrile and styrene, epoxy resins, phenolic resins, and phenoxy resins, etc. The charge transport coating composition can be coated on the charge generation layer using any appropriate coating technique; preferably, the Mayer-Bar coating or dip coating methods are used. Preferably, the ratio between the charge transport material and the polymer binder ranges from 1:3 to 3:1, and the thickness of the charge transport layer is preferably from 10 to 30 μm.

After the charge transport layer is coated, an overcoating composition is prepared which contains about 5 to 8 wt % of maleic acid di-allyl ester, about 1 to 5 wt % of a heat-induced curing initiator (i.e., a polymerization initiator), and the balance containing a bifunctional 3,9-divinyl spirobi(m-dioxane) and styrene. The styrene monomer may be replaced with chlorostyrene. Preferred curing initiators include p-dicumyl peroxide. After the overcoating composition is prepared, it can be coated on the charge transport layer using any of the appropriate coating methods, and then cured at 120° to 150° C. for one hour to form the overcoating layer. Preferably, the overcoating layer has a thickness of about 1.5 μm.

Optionally, a blocking layer can be formed between the conductive substrate and the charge generation layer, so as to block the back-injection of holes from the conductive substrate into the charge generation layer. The existence of the blocking layer has shown to further improve the performance of the organic photoconductors. Preferred materials for making the blocking layer include polyamide, polyvinyl alcohol, nitrocellulose, polyurethane, casein, etc., and the blocking layer preferably should have a thickness from 0.1 to 0.3 μm.

BRIEF DESCRIPTION OF THE DRAWING

The present invention will be described in detail with reference to the drawing showing the preferred embodiment of the present invention, wherein.

DETAILED DESCRIPTION OF THE 'PREFERRED EMBODIMENT

Figure 1:
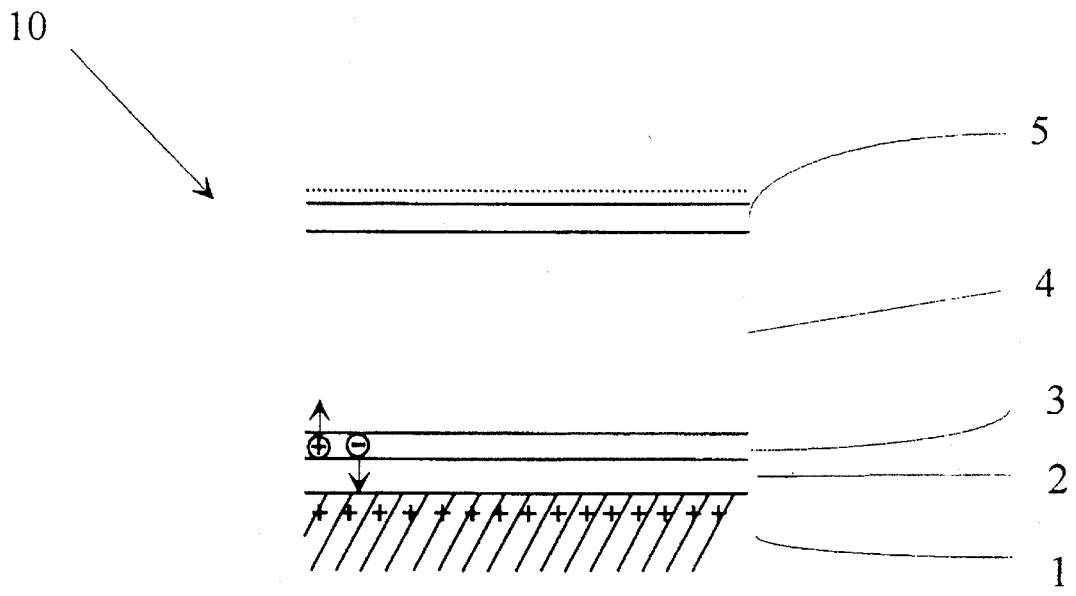
FIG. 1 is a schematic drawing showing the various layers constituting the organic photoconductor of the present invention (from bottom to the top): an aluminum substrate, a blocking layer, a charge generation layer, a charge transport layer, and a reinforcing overcoating layer.

The primary present invention discloses an improved organic photoconductor (or organophotoconductor, or OPC), which exhibits excellent light and heat stability, and excellent abrasion resistance comparative to those observed from inorganic photoconductors, but do not have the problems such as toxicity and enviromental pollution problems that are typically associated with the inorganic photoconductors.

FIG. 1 is a schematic drawing showing the various layers, from bottom to the top, constituting the organic photoconductor 10 of the present invention: an aluminum substrate 1, a blocking layer 2, a charge generation layer 3, a charge transport layer 4, and a reinforcing overcoating layer 5. The thicknesses of the blocking layer 2, the charge generation layer 3, the charge transport layer 4, and the resin reinforcing overcoating layer 5 are about 0.1 to about 3 μm, about 0.1 to about 1 μm, about 10 to about 30 μm, and about 1.5 μm, respectively. The improved organic photoconductor disclosed in the present invention belongs to the type of functionally-separated multiple-layered photoconductors. The overcoating layer of the improved organic photoconductor disclosed in the present invention is a reinforcing polymer resin layer containing a copolymer of (3,9-divinyl spirobi(m-dioxane)) and styrene. The reinforcing polymer resin layer imparts substantially improved light and heat resistance, as well as improved hardness and abrasion-resistance to the organic photoconductors.

The charge generating layer is first prepared by dispersing a charge generating material in a polymer binder and an appropriate solvent to form a charge generating coating composition. Preferred charge generation materials include squarylium pigments and bisazo pigments. Examples of the preferred charge generation materials are disclosed in U.S. Pat. No. 5,270,139, the content of which has been incorporated by reference. The charge generating coating composition is coated on the conductive substrate using one of many appropriate coating procedures, such as dip-coating, blade coating, flow coating, spraying, draw bar coating, and Meyer Bar-coating, etc., to form a charge generation layer of about 0.1 to 1 μm. After coating, the charge generating layer is placed inside an oven and dried. The polymer binder should be a polymeric insulator, and the preferred polymer binders include polyesters, polycarbonates, polyvinyl butyrate, phenolic resins, polyamides, and phenoxy resins. The ratio between the charge generating material and the polymer binder should preferably be between 3:1 and 1:3, by weight. The organic solvents to be used in conjunction with the polymer binder should be those which can dissolve the polymer binder but do not dissolve the charge generating material. Preferred organic solvents for use in preparing the charge generation layer include tetrahydrofuran, 1,4-dioxane, cyclohexanone, methyl ethyl keton, N,N-diethylformamide, etc. The solid content in the charge generating composition should preferably be between 0.5% and 5.0%, by weight.

The charge transport layer is formed by coating a layer of a charge transport material onto the charge generation layer. The charge transport layer is prepared by dissolving the charge transport material and a polymer binder in an appropriate solvent to prepare the charge transport coating composition. Preferred charge transport materials include hydrazones such as p-diethylaminobenzaldenyde-N-N-diphenyl hydrazone; 2-pyrazolines such as 1-phenyl-3-(p-diethylaminophenyl-propenol)- 5-(p-diethylaminophenyl)2-pyrazoline; and triaryl methanes such as bis(4-diethylamino-2-methylphenyl)-phenylmethane. Preferred polymer binders for use in preparing the charge transport layer include acrylic resins, polyallylates, polyesters, polycarbonates, polystyrenes, copolymers of acrylonitrile and styrene, epoxy resins, phenolic resins, and phenoxy resins. The charge transport coating composition can be coated on the charge generation layer using any appropriate coating technique; preferably, the Mayer-Bar coating or dip coating methods are used. Preferably, the ratio between the charge transport material and the polymer binder ranges from 1:3 to 3:1, and the thickness of the charge transport layer is preferably from 10 to 30 μm.

The overcoating composition is prepared by mixing: (1) about 5 to 8 wt % of maliec acid diallyl ester; (2) about 1 to 5 wt % of a curing initiator (i.e., a polymerization initiator), (3) and the balance (i.e., from about 87 wt % to about 94 wt %) of a bifunctional 3,9-divinyl spirobi(m-dioxane) and styrene. The styrene monomer may be replaced with chlorostyrene. Preferred curing initiators include p-dicumyl peroxide. After the overcoating composition is prepared, it is coated on the charge transport layer using any of the appropriate coating methods, and then cured at 120° to 150° C. for one hour to form the overcoating layer. Preferably, the overcoating layer has a thickness of about 1.5 μm.

The blocking layer, which is formed between the conductive substrate and the charge generation layer, provides the function of blocking the potential back-injection of electronic holes from migrating from the conductive substrate into the charge generation layer. The existence of the blocking layer is to further improve the performance of the organic photoconductors. Preferred materials for making the blocking layer include polyamide, polyvinyl alcohol, nitrocellulose, polyurethane, casein, etc., and the blocking layer preferably should have a thickness from 0.1 to 0.3 μm.

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed.

EXAMPLE 1

Step (1): preparation of blocking layer coating composition

Into a mixture solvent containing 300 g methanol and 100 g n-butanol, 50 g of polyamide was dissolved. After vigorous stirring, a blocking layer coating composition was obtained.

Step (2): Preparation of charge generation coating composition 2.25 g of bisazo pigment and 2.25 g squarylium pigment were mixed in a 500-ml grinding can. Then 0.8-cm diameter stainless steel balls were added into the grinding can until abut two thirds of its volume was filled. The mixture was dry-milled in a homomixer for 4 hours. Thereafter, 219 g of cyclohexanone solution containing 2.57 wt % polyvinyl butyral was added to the mixture and milled in the homomixer for another 6 hours. Finally, 200 g of cyclohexanone was added to dilute the homomixed mixture. This formed the charge generation coating composition.

Step (3): Preparation of charge transport coating composition 50 g of polycarbonate was dissolved in 500 g toluene to form a polymer binder solution. Then 50 g of a charge transport material according to the following formula was added to the polymer binder solution:

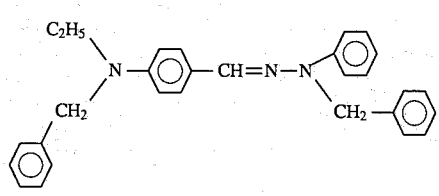

After thorough mixing, a charge transport coating composition was obtained.

Step (4): Preparation of reinforcing overcoating resin composition

An overcoating composition was prepared by mixing (1) 5.5 wt % of maliec acid di-allyl ester; (2) about 1 wt % of a heat-curing initiator (p-dicumyl peroxide.), and (3) the balance of a bifunctional 3,9-divinyl spirobi(m-dioxane) and styrene, at a weight ratio of 10/1. After thorough mixing, an overcoating composition containing a reinforcing resin was prepared.

Step (5): Preparation of organic photoconductor

The blocking composition prepared in Step (1) above was coated on the surface of a conductive aluminum substrate using a dip coating method. The coated substrate was placed inside an oven at 95° C. for 30 minutes. After hardened, a blocking layer having a thickness of 1 μm was obtained. Then, the charge generation coating composition prepared in Step (2) above was coated on top of the blocking layer, also using the dip coating method, and dried in a 95° C. oven for 30 minutes. After hardened, a charge generation layer having a thickness of 0.3 μm was obtained. A charge transport layer was similarly formed by coating the charge transport coating composition prepared in Step (3) above on top of the dried charge generation layer, using the dip coating method. After hardened, the charge transport layer had a thickness of 17 μm. Finally, the overcoating composition prepared in Step (4) above was coated on the charge transport layer using the dip coating method. After curing in a 150° C. oven for one hour, a reinforcing overcoating resin layer having a thickness of 1.47 μm was obtained.

The organic photoconductor prepared in Step (5) above was tested to evaluate its abrasion resistance, film thickness, surface hardness, dark decay, photoconductivity. The surface hardness was measured using a pencil hardness tester in accordance with ASTM D-336. Abrasion resistance was measured using a Canon OEM blade. The contact angle between the blade and the organic photoconductor was fixed to be at 20°, and a force of 1 KgW/240 mm at 30 cycles/min was applied. After 10,000, 20,000, and 30,000 cycles, its film thickness was measured using a film thickness tester to evaluate the decrease in film thickness due to abrasion. Photoconductivity of organic photoconductor samples was tested using Electrostatic Paper Analyzer Model EPA-8100 (by Kawaguchi Electric, Japan). The corona charge was set at −5.0 kV, and the corona rate was set at 5 m/min. The initial surface potential of the test sample was measured and recorded as $V_o$. After 2 seconds of dark decay, the surface potential was measured and recorded as $V_d$. The residual surface potential, $V_r$, was also measured under various conditions. After the test sample exposed to an infrared light source having an intensity of 10 Lux had been subjected to 30,000 cycles at 30 cycles/min, the surface potential thereof was allowed to attentuate. Half decay exposure, which is defined as the amount of light energy that was consumed when the surface potential dropped to one half of the value of $V_d$, was calculated and recorded as $E_{1/2}$. (in Lux·sec). Results of these tests which are summarized in Table 1, indicated that the photoconductor prepared in Example 1 had a $V_o$ of −690.4 volts, $V_d$ of −669 volts, and a hardness of 4H. Table 1 also showed that, after 30,000 cycles, the decrease in the total thickness of the multiple coating layers was only 0.095 μm, and the measured $E_{1/2}\cdot V_d$ was 0.28 gW/cm$^2$. The measured values of $V_r$ are shown in Table 2.

EXAMPLE 2

The procedure and conditions in Example 2 were identical to those in Example 1, except that the overcoating composition contained 8 wt % of maliec acid di-allyl ester, 5 wt % of p-dicumyl peroxide, and the balance, 3,9-divinyl spirobi(m-dioxane) and styrene at a weight ratio of 5/1, and that the overcoating layer was cured at 120° C. for one hour. The thickness of the overcoating layer was measured to be 1.50 μm. Test results from the organic photoconductor prepared in Example 2 are also summarized in Table 1, which showed $V_o$, $V_d$, hardness, decrease in total thickness (after 30,000 cycles), and $E_{1/2}\cdot V_d$ of −689.5 volts, −651.4 volts, 4H, 0.097 μm, and 0.28 μW/cm$^2$, respectively.

EXAMPLE 3

The procedure and conditions in Example 3 were identical to those in Example 1, except that the overcoating composition contained 8 wt % of maliec acid di-allyl ester, 5 wt % of p-dicumyl peroxide, and the balance, 3,9-divinyl spirobi(m-dioxane) and styrene at a weight ratio of 1/1, and that the overcoating layer was cured at 120° C. for one hour, and the thickness of the overcoating layer was measured to be 1.65 μm. Test results from the organic photoconductor prepared in Example 3 are also summarized in Table 1, which showed $V_o$, $V_d$, hardness, decrease in total thickness (after 30,000 cycles), and $E_{1/2} \cdot V_d$, of −689.7 volts, −687.0 volts, 3H, 0.124 μm, and 0.28 μW/cm$^2$, respectively.

Comparative Example

The procedure and conditions in the Comparative Example were identical to those in Example 1, except that the organic photoconductor did not contain the overcoating layer. Test results from the organic photoconductor prepared in the Comparative Example are summarized in Table 1, which showed $V_o$, $V_d$, hardness, decrease in total thickness (after 30,000 cycles), and $E_{1/2} \cdot V_d$, of −695.1 volts, −681.6 volts, H, 6.3 μm, and 0.26 μW/cm$^2$, respectively.

From Table 1, it is clearly shown that the overcoating layer provided in the present invention has greatly improved the service life of the organic photoconductors. However, the values of $V_r$ as shown in Table 2 also clearly indicate that this overcoating layer, while it can greatly enhance the service life of organic photoconductors, does not cause any adverse effect on the performance (measured based on the residual potential at various conditions) thereof.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

TABLE 1

| Example | $V_o$ (volts) | $V_d$ (volts) | Surface Hardness | Decrease in Thickness (μm) after 30,000 cycles | $E_{1/2} \cdot V_d$ (μW/cm$^2$) |
|---|---|---|---|---|---|
| 1 | −690.4 | −669.0 | 4H | 0.095 | 0.28 |
| 2 | −689.5 | −651.4 | 4H | 0.097 | 0.28 |
| 3 | −698.7 | −687.0 | 3H | 0.124 | 0.28 |
| Comp. Ex. | −695.1 | −681.6 | H | 6.3 | 0.26 |

TABLE 2

| Example | $V_r$ (volts) | $V_r$ (volts), exposed to an infrared light source having an intensity of 10 Lux: Initial Value | After 30,000 cycles |
|---|---|---|---|
| 1 | −22.0 | −30.1 | −70.0 |
| 2 | −20.0 | −40.0 | −70.1 |
| 3 | −18.5 | −30.6 | −70.1 |
| Comp. Ex. | −20.5 | −35.1 | −70.1 |

What is claimed is:

1. An organic photoconductor comprising:

(a) a conductive substrate;

(b) a charge generation layer;

(c) a charge transport layer; and (d) a reinforcing layer; wherein said reinforcing layer contains a polymer resin prepared from a reaction mixture comprising:

(i) about 87 to 94 wt % of a bifunctional 3,9-divinyl spirobi(m-dioxane) and styrene;

(ii) about 5 to 8 wt % of maliec acid di-allyl ester; and (iii) about 1 to 5 wt % of a heat-induced polymerization initiator.

2. An organic photoconductor according to claim 1 wherein said 3,9-divinyl spirobi(m-dioxane) and said styrene are provided at a weight ratio of between about 10/1 and about 1/1.

3. An organic photoconductor according to claim 1 wherein said 3,9-divinyl spirobi(m-dioxane) and said styrene are provided at a weight ratio of about 10/1.

4. An organic photoconductor according to claim 1 wherein said 3,9-divinyl spirobi(m-dioxane) and said styrene are provided at a weight ratio of about 5/1.

5. An organic photoconductor according to claim 1 wherein said 3,9-divinyl spirobi(m-dioxane) and said styrene are provided at a weight ratio of about 1/1.

6. An organic photoconductor according to claim 1 wherein said reinforcing overcoating layer has a thickness of about 1.5 μm.

7. An organic photoconductor according to claim 1 wherein said charge generation layer has a thickness of between about 0.1 μm and about 1 μm.

8. An organic photoconductor according to claim 1 wherein said charge transport layer has a thickness of between about 10 μm and about 30 μm.

9. An organic photoconductor according to claim 1 which further comprises a blocking layer provided between said said charge generation layer and said conductive substrate.

10. An organic photoconductor according to claim 9 wherein said blocking layer has a thickness of between about 0.1 μm and about 3.0 μm.

11. An organic photoconductor according to claim 1 wherein said charge transport layer is provided between said said charge generation layer and said reinforcing overcoating layer.

12. An organic photoconductor according to claim 1 wherein said charge transport layer contains a charge transport material dissolved in a polymer binder and said charge transport material is represented by the following formula:

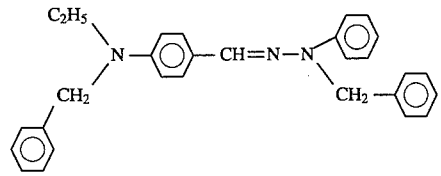

13. An organic photoconductor according to claim 1 wherein said heat-induced polymerization initiator comprises p-dicumyl peroxide.

* * * * *